United States Patent [19]

Lautenschläger et al.

[11] Patent Number: 4,720,896

[45] Date of Patent: Jan. 26, 1988

[54] CABINET HINGE

[75] Inventors: Horst Lautenschläger, Reinheim; Gerhard Lautenschläger, Brensbach 1-Wersau, both of Fed. Rep. of Germany

[73] Assignee: Karl Lautenschläger GmbH & Co. KG, Reinheim, Fed. Rep. of Germany

[21] Appl. No.: 861,078

[22] Filed: May 8, 1986

[30] Foreign Application Priority Data

May 8, 1985 [DE] Fed. Rep. of Germany ..... 3516480

[51] Int. Cl.[4] ..... E05D 5/00

[52] U.S. Cl. ..... 16/382; 16/236; 16/245; 16/370

[58] Field of Search ..... 16/238, 236, 237, 240, 16/246, 270, 254, 370, 382, 366, 368

[56] References Cited

U.S. PATENT DOCUMENTS

| | | | |
|---|---|---|---|
| 3,391,723 | 7/1968 | Kirby | 16/238 |
| 3,977,041 | 8/1976 | Rock et al. | 16/238 |
| 4,159,557 | 7/1979 | Pittasch et al. | 16/237 |
| 4,312,098 | 1/1982 | Sundermeier | 16/240 |
| 4,493,129 | 1/1985 | Grass | 16/238 |

FOREIGN PATENT DOCUMENTS

| | | | |
|---|---|---|---|
| 3114424 | 12/1982 | Fed. Rep. of Germany | 16/236 |

*Primary Examiner*—Nicholas P. Godici
*Assistant Examiner*—G. M. Reid

[57] ABSTRACT

Hinge for hanging a door on the facing of a cabinet. The carcase-related part of the hinge, in the form of an elongated door-supporting arm, can be adjustably fastened on a mounting plate preinstalled on the inside surface of the facing, while its free end, which is angled toward the door, is coupled to a door-related member in the form of a hollow cup by means of a four-joint mechanism. The door-supporting arm is fastened to the mounting plate through an intermediate piece which is disposed in its rearward end portion between the supporting arm and the mounting plate and is mounted releasably on the mounting plate and on the supporting arm of adjustment by a certain amount lengthwise of the supporting arm. The intermediate piece and the supporting arm are coupled together by a threaded spindle (84) which is in threaded engagement with one of the coupled parts while it is connected to the other part in such a way that it is rotatable, but non-displaceable lengthwise relative thereto.

6 Claims, 8 Drawing Figures

CABINET HINGE

BACKGROUND OF THE INVENTION

The invention relates to a hinge for hanging a flush door on a cabinet carcase in which the size of the door opening is defined by the cabinet facing, the door when closed being set within the facing. Such a hinge has a four-joint mechanism whose pivot axis shifts in space and whose links are pivoted at their door-related extremities in a cup set in a recess in the back of the door, and at their carcase-related extremities on a door-supporting arm adjustably mounted on a mounting plate fastened to the inner surface of the facing; the supporting arm projects toward the door opening beyond the edge of the cabinet facing, and its cantilevered front end section is bent approximately at right angles to the door and, when the door is closed, enters the interior of the cup.

The known hinge of this kind (DE-OS No. 24 58 294) has proven practical for the special application for which it was intended, namely the hanging of a door on a cabinet carcase in which the size of the door opening is defined by the cabinet casing, and for that reason it is used to a considerable extent on such cabinets. The manner in which the supporting arm is adjustably fastened on the mounting plate (which is fastened to the back of the facing) is the same as in the case of the normal hanging of doors by means of hinges provided on the carcase side wall, i.e., after loosening a screw driven through a slot in the back of the door-supporting arm into a tap in the mounting plate, the supporting arm can be shifted relative to the mounting plate to the degree permitted by the length of the slot, and can be locked in place again at selected positions along the slot by tightening the screw. The longitudinal adjustment of the supporting arm of such hinges, however, is a rather difficult task, because it is possible that a correct setting or one that needs to be corrected but slightly will immediately be lost when the screw is loosened, since the weight of the door acts on the front end of the supporting arm and seeks to shift it out of place. In ordinary cabinets, i.e., cabinets without any facing, the supporting wall is easy to reach when the door is open, so that any unintentional shifting of the hinge when the screw is loosened can be prevented by pressing the supporting arm against the mounting plate. Owing to the greater difficulty involved in reaching the supporting arm (and mounting plate) on the back of the cabinet facing, such adjustment of the known hinge is more difficult, and as a rule requires the aid of a second person to support the door while the adjustment is being made.

The invention is addressed to the problem of improving the known hinges when they are intended for the special application described above, such that, in addition to being able to be installed and removed with the same simplicity and speed, they will be precisely and accurately adjustable without difficulty, while any undesired and unintended shifting will be impossible.

SUMMARY OF THE INVENTION

Setting out from a hinge of the kind described above, this problem is solved according to the invention by the fact that, in the area of the supporting arm end remote from the hinge linkage, between the supporting arm and the mounting plate, there is releasably disposed an intermediate piece mounted for displacement on the mounting plate and on the supporting arm over a given distance lengthwise of the supporting arm, and that the intermediate piece and the supporting arm are coupled together by a threaded shaft which is disposed parallel to its direction of adjustment and whose threads are engaged in one of the coupled parts, while it is connected to the other part in such a way that it is rotatable, but non-displaceable lengthwise relative thereto. The functions of fastening and removing the supporting arm to or from the mounting plate and the function of the longitudinal adjustment of the supporting arm relative to the mounting place are thus separated from one another by the intermediate piece, in that the first function is provided by the releasable fastening of the intermediate piece to the mounting plate and the second function by the relative displaceability of the supporting arm on the intermediate piece and the possibility for continuous adjustment provided by the threaded coupling by means of a threaded shaft. Since such engagement of screw threads is self-locking, accidental loss of adjustment is impossible.

In advantageous further development of the invention, the intermediate piece and the mounting plate are each provided with a projection extending substantially at right angles to the direction of adjustment of the supporting arm, which can be brought into engagement with one another, and in both of which at least one bore is provided, the two bores being in alignment with one another, and at least the bore provided in the projection of the mounting plate being a threaded bore into which the shaft of a screw joining the two projections together can be driven. Thus, by loosening this one screw, the intermediate piece as well as the door-supporting arm can be separated from the mounting plate, this screw being also very easily accessible by providing it on projections of the supporting arm. This is especially the case when the projections are situated one behind the other in the direction of displacement, and the aligned bores provided in them run in the direction of the adjusting movement of the door-supporting arm.

The door-supporting arm can then desirably be provided at its end remote from the hinge pivot axis with a cutout to accommodate the projections. If the supporting arm is of the common elongated type having a back and two sides, the intermediate piece can be disposed between the inside surface of the back of the supporting arm and a pin which is held at each end in the supporting arm sides. In comparison with other displaceable arrangements of the intermediate piece in the supporting arm, which could also be made within the concept of the invention, using, for example, dovetail guides or tongue-and-groove joints, mounting the intermediate piece for displacement between the sides of the supporting arm and protecting it against lifting away by means of the pin is simpler and thus less expensive.

The positive, self-locking adjustability between the supporting arm and the intermediate piece is brought about in a preferred embodiment of the invention in the following manner: In the plane of separation between the inside surface of the back of the supporting arm and the confronting surface of the intermediate piece a bore is provided which runs in the direction of displacement of the supporting arm and is situated half in the intermediate piece and the other half in a raised section of the back of the supporting arm. One half of the bore is threaded for engagement by an adjusting screw whose thread is interrupted by an annular groove. The other half of the bore is smooth except for a transverse ridge which engages the annular groove in the adjusting screw. The front of the raised section facing the hinge links is open, so that the head of the adjusting screw is exposed in the opening for engagement by a tool. The threaded half of the bore is preferably provided in the intermediate piece, so that, when the adjusting screw is rotated, the supporting arm will be displaced together with the screw with respect to the intermediate piece.

To permit an additional adjustment of the door in the direction of the depth of the carcase, the door-supporting arm of the hinge can have in its back a threaded bore to accommodate an adjusting screw whose end adjacent the mounting plate terminates in a holding head of increased diameter which is engaged so as to be unable to escape from the mounting plate in a slot open at the hinge-link end. In that case it is recommendable to provide on the projection extending from the intermediate piece, at the surface confronting the projection of the mounting plate, a bevel beginning from the center of its bore and extending to its free end, and having an angle corresponding to the maximum angle of the adjustment of the supporting arm relative to the mounting plate by means of the adjusting screw provided with the holding head. When the supporting arm is adjusted in the direction of the depth of the carcase by turning the adjusting screw provided with the holding head, the apex formed by the bevel at the center of the projection of the intermediate piece will then constitute, so to speak, a fulcrum on the mounting plate for the supporting arm, i.e., no appreciable misalignment of the bores in the projections of the intermediate piece and mounting plate will occur.

The bores provided in the projections of the intermediate piece and mounting plate are preferably both threaded bores of the same thread dimensions. The shaft of the corresponding screw will have between its front, threaded end and the its head an unthreaded section whose diameter is smaller than the inside diameter of the threaded bores and whose length is at least equal to the bore provided in the projection of the intermediate piece. This makes it possible to pre-install the screw in the bore of the projection of the intermediate piece by driving the front end of its threaded shaft into it. Then, however, if the screw is driven all the way into the threaded bore in the mounting plate projection, the unthreaded section of its shaft will come within the projection of the intermediate piece, so that then it will have no threaded engagement with the latter, and it is possible to tighten the screw such that the two projections of the intermediate piece and mounting plate are urged into tight engagement with one another.

BRIEF DESCRIPTION OF THE INVENTION

The invention will be further explained in the following description of an embodiment, in conjunction with the drawing, wherein:

FIGS. 1 and 2 are diagrammatic side views of a door hung on a cabinet facing with a hinge according to the invention, FIG. 1 representing the closed state of the door and FIG. 2 the open state, FIG. 3 is a perspective view of the hinge according to the invention, FIG. 4 is a sectional view through the hinge supporting arm adjustably mounted on the mounting plate, as seen in the direction of the arrows 4—4 of FIG. 3, FIG. 5 is a sectional view substantially corresponding to FIG. 4, in which the supporting arm, the intermediate piece, the mounting plate, and the parts joining them together, are represented in the disassembled state, FIG. 6 is a plan view seen in the direction of the arrow 6 in FIG. 4, FIG. 7 is a plan view of the intermediate piece which couples together the supporting arm and the mounting plate, seen in the direction of the arrow 7 in FIG. 5, and FIG. 8 is a plan view of the mounting plate, as seen in the direction of the arrow 8 in FIG. 5.

DETAILED DESCRIPTION OF A PREFERRED EMBODIMENT

Figure 1:
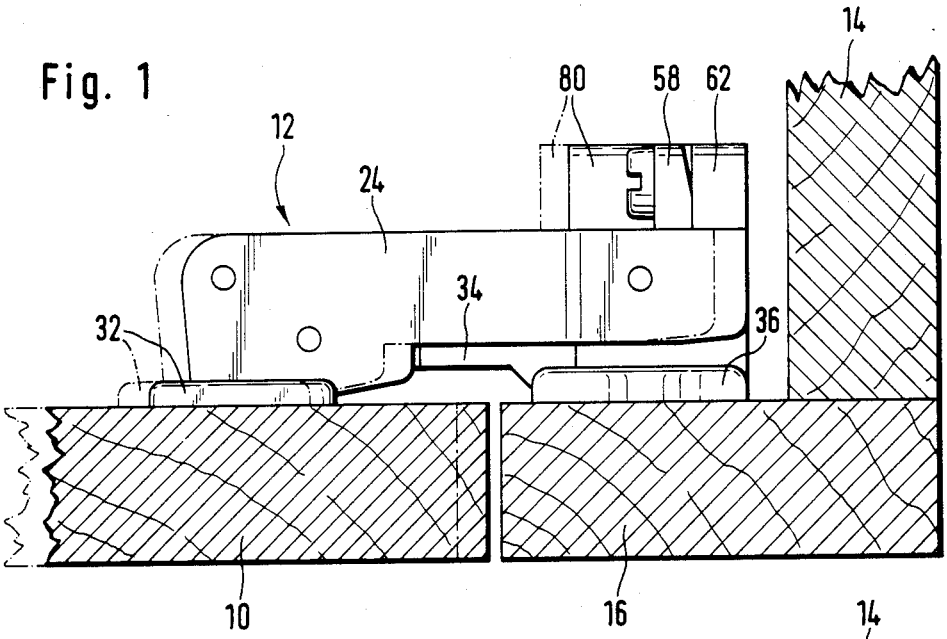
Figure 2:
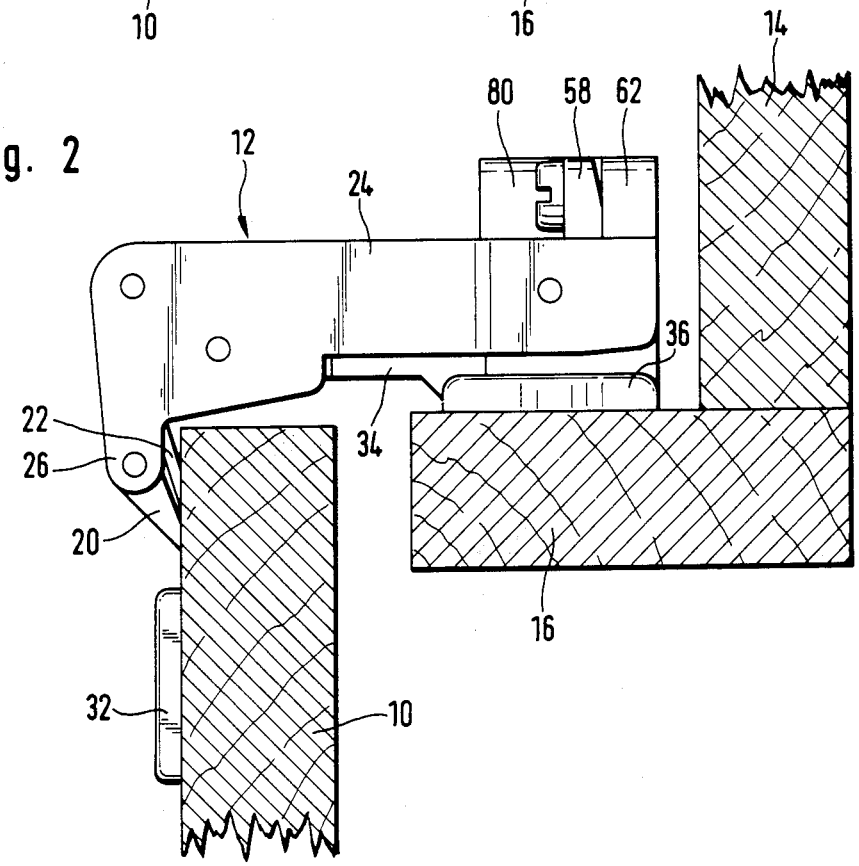
Figure 3:
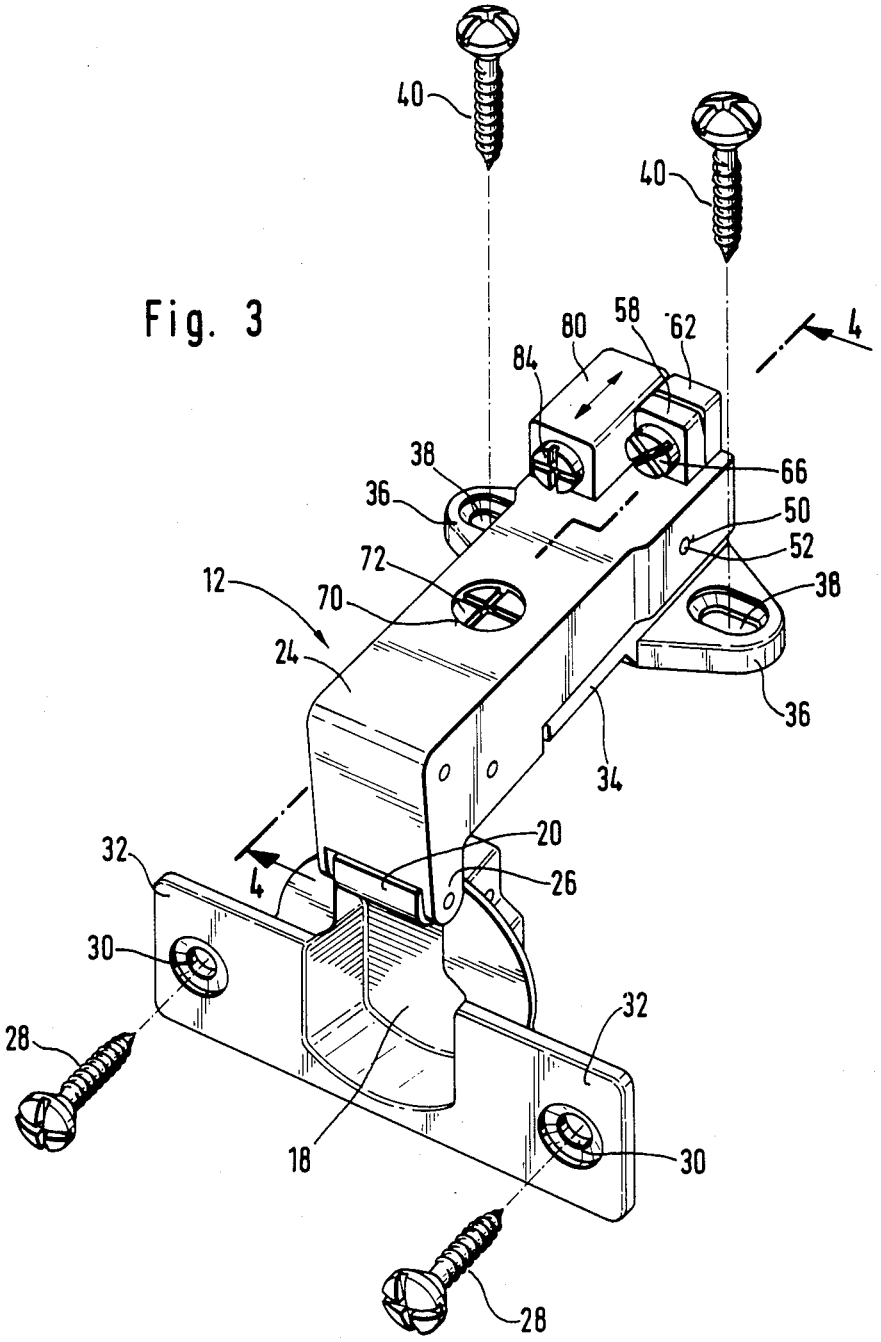

In FIGS. 1 and 2, the pivotal linking of a door 10 to a cabinet by means of a hinge constructed in the manner of the invention and designated as a whole by the number 12 is represented diagrammatically; only the front portion of the cabinet side wall 14 and its facing member 16 forming the doorway are represented. The hinge 12, as it can be seen especially in FIG. 3, has a cup 18 which can be set flush into a recess on the back of the door, and in which one end of each of two hinge links 20 and 22 is pivotally mounted, while their other ends are connected pivotally to an elongated door-supporting arm 24 which has at its front end, i.e., the end at which the cup 18 is attached, a portion 26 projecting at right-angles which, when the door 10 is closed (FIG. 1), lies inside of the cup 18. The cup 18 is fastened to the door 10 in the illustrated case by screws 28 which are driven into the door 10 through countersunk bores 30 provided in laterally projecting flanges 32 of the cup 18 against the back of the door. The supporting arm 24, on the other hand, is adjustably mounted on a mounting plate 34 which in turn is fastened on the inside surface of the facing member 16. In the case represented, the mounting plate 34 is in the form of a so-called "wing plate," i.e., it has two fastening flanges 36 extending wing-like from its elongated middle part over which the supporting arm is fitted, and in these flanges there are provided the countersunk slots 38 through which screws 40 can be driven into the facing member 16. The mounting plate is fastened to the facing member such that it extends slightly beyond the latter into the doorway.

Figure 4:
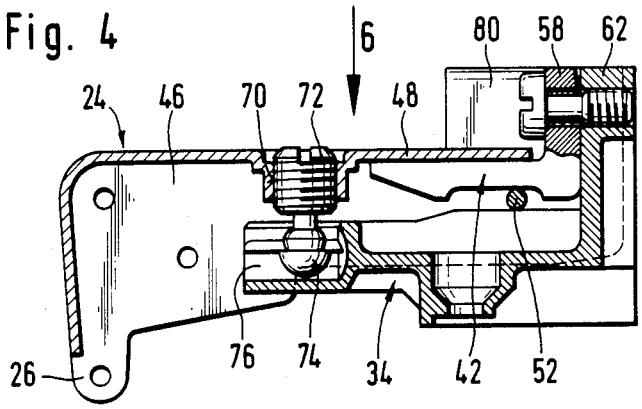
Figure 5:
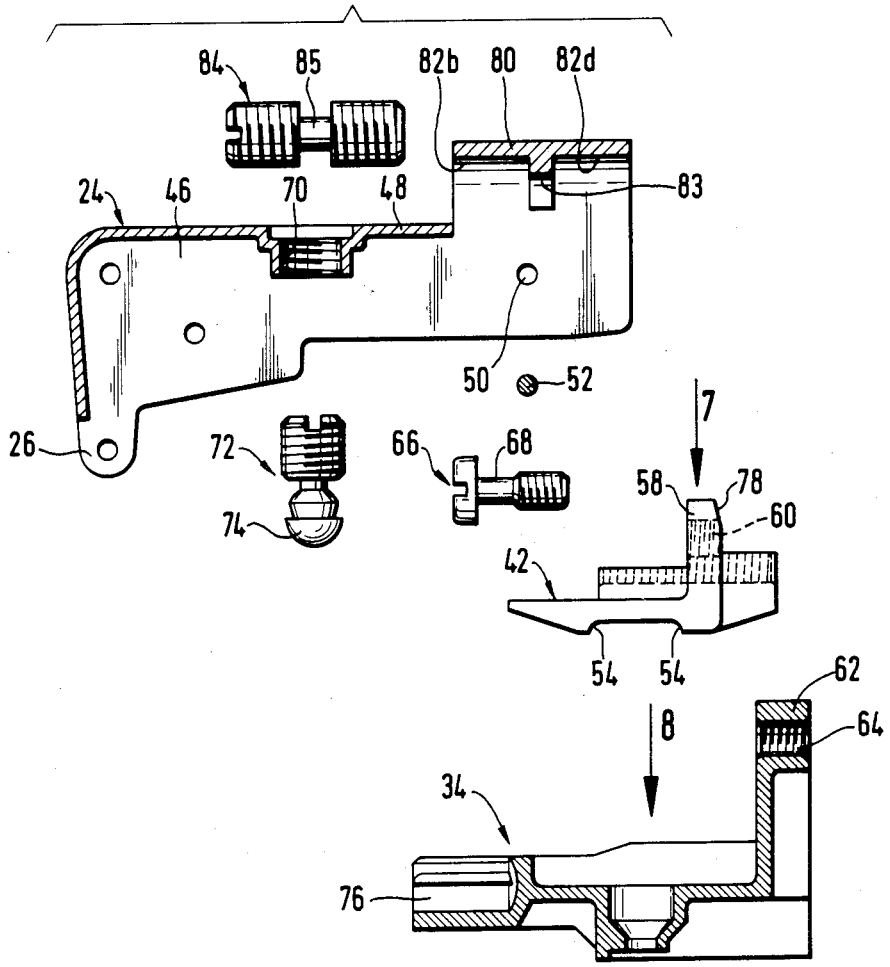
Figure 6:
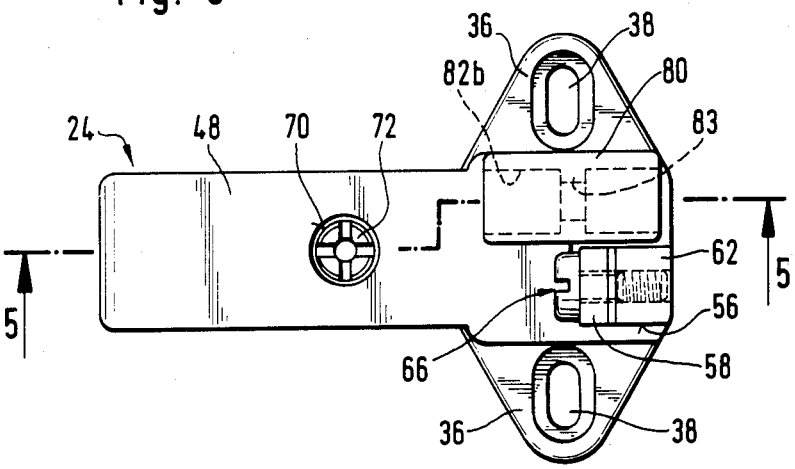
Figure 7:
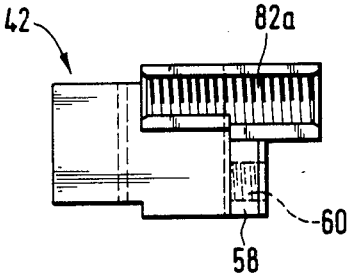
Figure 8:
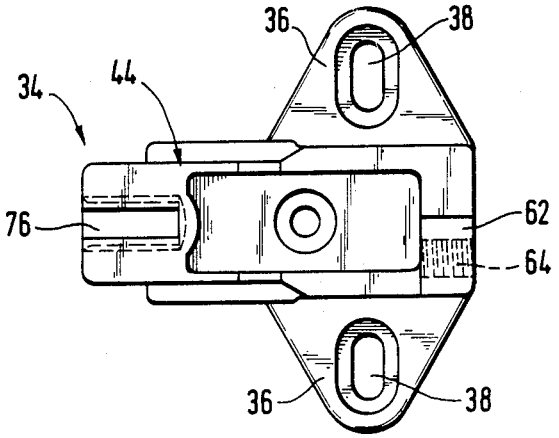

The supporting arm 24 is fastened on the mounting plate 34, not directly but, as it can be seen especially in FIGS. 4 and 5, with the interposition of an intermediate piece 42. The sides 46 of the channel-like supporting arm 24 straddle the elongated middle part 44 of the mounting plate 34, while the intermediate piece 42 is disposed for longitudinal displacement between these sides 46, underneath the back 48 of the door-supporting arm 12. A pin 52 passing crosswise through the supporting arm beneath the intermediate piece 42 and held in bores 50 in the sides 46 holds the intermediate piece 42 so as to enable the latter to be displaced in the supporting arm, the relative displacement of supporting arm 24 and intermediate piece 42 being limited by establishing abutments 54 on the bottom of the intermediate piece 42.

In its rearward end portion, the intermediate piece 42 has a projection 58 extending at right angles at the rearward end of the back 48 of the supporting arm and having a threaded bore running lengthwise of the supporting arm. With the projection 58 there is associated a projection 62 extending from the rearward end of the mounting plate 34 and through the cutout 56 in back of the projection 58. By means of a screw 66 first passing through the threaded bore 60 and then engaged in the threaded bore 64, the intermediate piece 42 and the mounting plate 34 are fastened releasably together, while a threadless section 68 of the screw, which is situated between its head and its forward, threaded portion, assures that, after the forward, threaded section has passed through, the screw 66 can be rotated freely in the threaded bore 60 and the projection 58 and projection 62 can thus be tightened together.

The supporting arm 24 has, at a distance from its rearward end, another threaded bore 70 in its back 48, into which an adjusting screw 72 is threaded, which bears at its bottom end facing the mounting plate, at the end of a short neck section of reduced diameter, a holding head 74, which in this case is spherical, and which is slipped through an opening at the front end of the mounting plate 34 into a tubular passage 76 having at the surface of the mounting plate a narrow slot to accommodate the short neck section of the adjusting screw. By turning the adjusting screw 72, the screw can be shifted toward or away from the mounting plate, thereby rocking the front end of the supporting arm relative to the mounting plate. A bevel 78 at the upper end of the side of projection 58 facing the projection 62 permits this rocking movement of the supporting arm without straining the projections 58 and 62, and it has been found that the screw 66 does not even have to be loosened if the bevel 78 begins from a line running across the center of the threaded bore 60. The apex thus formed on the projection 58 constitutes, so to speak, the fulcrum on which the supporting arm 24 turns when it is adjusted by turning the adjusting screw 72.

For the positive self-locking longitudinal adjustment of the supporting arm 24 relative to the intermediate piece 42 and thus to the mounting plate 34, there is provided in the plane of separation between the inside surface of the back 48 of the supporting arm and the confronting surface of the intermediate piece 42 a bore 82 whose half **82*a* within the intermediate piece 42 is threaded, while the half 82*b* within the raised section 80 is smooth except for a ridge 83 projecting radially approximately at the center. In the bore 82 there is an adjusting screw 84 which is in threaded engagement with the bore half 82*a* and has a circumferential annular groove 85 which is engaged by the ridge 83 in the bore half 82*b*. When the adjusting screw 84 is turned through the open front end of the raised section 80, the adjusting screw 84 engages the threaded bore half 82*a* and thus drives the supporting arm with it by means of the ridge 83 which engages the annular groove 85. Since the threaded engagement between the adjusting screw 84 and the threaded bore half 82*a* is self-locking to the extent threaded screws and bores are (as distinguished from threaded spindles), no additional fixation of any setting that has been made is necessary. A setting once made will be maintained even when a door mounted on the cabinet by means of the hinge 12 according to the invention is removed and afterward reinstalled. To remove the door, the screw 66 is simply removed from the threaded bore 64 of the projection 62, and then the door together with the supporting arm 24 and the intermediate piece 42 held in the supporting arm can be withdrawn from the mounting plate 34. It is clear that in this case the adjustment between the supporting arm 24 and the intermediate piece 42 remains unaltered, so that, after the reinstallation of the door 10** on the cabinet, no readjustment of the supporting arm relative to the mounting plate is necessary.

We claim:

1. A hinge for pivotally connecting a door leaf to a cabinet carcase having a carcase frame projecting at right angles from carcase walls, the carcase frame having an edge defining a clear door opening, the door leaf when closed being inside the clear door opening; said hinge comprising: a cup for mounting in a recess in the door leaf, a mounting plate for mounting on the carcase frame, an elongated supporting arm adjustably mounted on said mounting plate end overreaching the edge of the carcase frame and having a free first and extending approximately at right angles from the mounting plate toward the cup, and extending into the cup when the door leaf is in the closed position, said supporting arm also having a second end remote from the first end, a four-joint mechanism having two hinge links, said hinge links having first ends pivotally mounted in said cup, and second ends pivotally mounted to said first end of said supporting arm, an intermediate piece at the second end of the supporting arm, said intermediate piece being arranged and releasably held on said mounting plate and on said supporting arm for displacement lengthwise of the supporting arm, a threaded spindle coupling said intermediate piece and said supporting arm, said spindle being disposed parallel to the direction of displacement of the arm and being in threaded engagement with one of said arm and intermediate piece, while being connected to the other one of said arm and intermediate piece so as to be rotatable, but non-displaceable axially relative thereto, said intermediate piece and said mounting plate each having a projection extending substantially at right angles to the direction of displacement of the supporting arm and reaching above the supporting arm, eahc projection having at least one bore each, said bores being aligned with each other, at least the bore in the projection of the mounting plate being a threaded bore, and a mounting screw having a shaft passing through said bores for joining the two projections, the projections lying one behind the other in the direction of displacement of the supporting arm, and the aligned bores running in the direction of displacement of the supporting arm, said second end of said supporting arm having a cutout to accommodate said projections.

2. A hinge according to claim 1, said elongated supporting arm being of substantially inverted -U cross section with lateral cheeks and a bridgewall joining said cheeks, the intermediate piece being disposed between the lateral cheeks and between the bridgewall and mounting plate, and a pin extending transversely under the intermediate piece through the supporting arm, the pin having ends held in the lateral cheeks.

3. A hinge according to claim 2, comprising a bore in the plane of separation between the bridgewall and the intermediate piece, said bore having a half in the intermediate piece and a half in a vaulted section of the bridgewall, the bore running in the direction of displacement of the supporting arm, one bore half having a thread, a threaded spindle lying in the bore and engaging the thread, the thread being interrupted by an annular goove which is engaged by a traverse ridge projecting from the other bore half which is smooth, a front face of the vaulted section facing the links being open, so that an end face of the threaded spindle is exposed in the opening and thereby accessible for engagement by a tool.

4. A hinge according to claim 3, wherein the bore half having a thread is in the intermediate piece.

5. A hinge according to claim 2, wherein the supporting arm has a threaded bore at a distance from said second end, in the bridge wall joining the lateral cheeks, a threaded spindle passing through the threaded bore, the spindle having a holding head at a first end facing the mounting-plate, said holding head being enlarged in diameter and engaging in a longitudinal groove which is located in the mounting plate, is open at a front end, and has a narrowed mouth securing the holding head against lifting away from the mounting plate, the projection of the intermediate piece being beveled on a surface facing the projection of the mounting plate, starting from a plane laid centrally transversely through the bore in the projection of the mounting plate, toward said free first end, by an angle corresponding approximately to the maximum adjustment angle of the supporting arm relative to the mounting plate by means of the threaded spindle provided with the holding head.

6. A hinge according to claim 2, wherein the bores in the projections of the intermediate piece and the mounting plate are threaded bores with equal thread dimensions, the shaft of the mounting screw has between a front, threaded end and the screw head an unthreaded section whose diameter is smaller than the thread inside diameter of the threaded bores and whose length is at least equal to the length of the bore in the projection of the intermediate piece.

* * * * *